US005902679A

United States Patent [19]

Kojima et al.

[11] Patent Number: 5,902,679

[45] **Date of Patent: *May 11, 1999**

[54] LOW TEMPERATURE ADHESIVE FIBER AND NONWOVENS MADE OF THE FIBER

[75] Inventors: Mitsuru Kojima, Moriyama; Yukinori Kataoka, Oumihachiman; Masayasu Suzuki, Shiga-ken, all of Japan

[73] Assignee: Chisso Corporation, Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/834,206

[22] Filed: Apr. 15, 1997

[30] Foreign Application Priority Data

Apr. 17, 1996 [JP] Japan ..... 8-119731
Oct. 14, 1996 [JP] Japan ..... 8-291180

[51] Int. Cl.[6] ..... D02G 3/00

[52] U.S. Cl. ..... 428/375; 428/389

[58] Field of Search ..... 428/373, 374, 428/375, 389

[56] References Cited

U.S. PATENT DOCUMENTS 4,211,819 7/1980 Kunimune et al. ..... 428/374
5,087,520 2/1992 Suzuki et al. ..... 428/375
5,652,051 7/1997 Shawver et al. ..... 428/373
5,654,086 8/1997 Nishijima et al. ..... 428/373
5,654,088 8/1997 Gupta et al. ..... 428/373

*Primary Examiner*—Newton Edwards
*Attorney, Agent, or Firm*—Wenderoth, Lind & Ponack, L.L.P.

[57] ABSTRACT

The present invention aims to provide a low tecmperture adhesive fiber, and nonwovens made of the fiber having high strength and soft feeling in spite of produced by heat treatment at a low temperature and a high-speed, and having strong adhesion with a hot melt adhesive, and an article having water absorption properties and being made of the nonwovens.

A low-temperature adhesive fiber, characterized in that a textile oil of 0.1–2.0% by weight per fiber, which comprises the following surfactant composition of 5–15% by weight of the following component (A), 5–45 % by weight of the following component (B) and 40–90% by weight of the following component (C), is adhered to a conjugate fiber of polyolefins having a core component of polypropylene and a sheath component of a bipolymer or terpolymer of olefins principally containing propylene:

(A) at least one alkali metal alkyl sulfonate, (B) at least one compound selected from polyol esters and fatty acid alkanol amides, (C) at least one compound selected from dibasic acid esters and polyethylene glycol esters.

11 Claims, No Drawings

LOW TEMPERATURE ADHESIVE FIBER AND NONWOVENS MADE OF THE FIBER

FIELD OF THE INVENTION

The present invention relates to a low-temperature adhesive fiber and nonwovens made of the fiber. More particularly, it relates to a low-temperature adhesive conjugate fiber of polyolefin having a low heat-treatment temperature and a process for obtaining the nonwovens at a low heat-sealing temperature of the nonwovens and having an excellent bond strength with adhesives, and it relates to the nonwovens made of the fiber.

DESCRIPTION OF THE PRIOR ART

Since the nonwovens made of heat-adhesive conjugate fibers of polyolefin have preferable characteristics such as soft feel and high strength, they are used as sanitary materials such as napkins and diapers. There are two heat-treatment methods for obtaining the nonwovens from the heat-adhesive conjugate fiber, namely, a hot-air adhering method using a suction band dryer or a suction drum dryer, and a hot-press method using a heating roll and the like. In these methods, the nonwovens for the sanitary materials having high strength are obtained by treating at a relatively high temperature to achieve a rapid production speed. However, increasing speed of heat-treatment to aim a rapid production of nonwovens makes the strength of nonwovens lower. On the other hand, the heat-treatment at a high temperature and at a high pressure to obtain nonwovens of high strength make the feel of the nonwovens hard, even though the strength was increased.

There are well-known (sheath/core) conjugate fibers of polyolefin, for example such a conjugate fiber of high-density polyethylene/polypropylene (abbreviated as HDPE/PP hereinafter), a conjugate fiber of high-density polyethylene/polyester (abbreviated as HDPE/PET hereinafter) and a fiber having a sheath component of propylene copolymer and a core component of polypropylene which is eccentrically positioned in the sheath (Japanese Patent Publication No. 55-26203, and Japanese Patent Application Laid-Open Nos. 2-91217 and 2-191720). A fiber comprising low-density polyethylene and low molecular weight polyethylene is known as a heat-adhesive non-conjugate fiber of polyolefin, (Japanese Patent Application Laid-Open No. 63-165511).

A conjugate fiber of HDPE/PP and a conjugate fiber of HDPE/PET that is mixed with other polyolefin fiber is known. The mixed fiber is used to improve characteristics such as permeability to liquid and bulkiness of sanitary nonwovens. Nonwovens comprising two layers of webs of different fibers laminated each other are also used. A diaper, which is obtained by covering with different kinds of nonwovens at a upper surface and a lower surface of a liquid absorption layer comprising of pulp and the like, doubling and heat-sealing the waist sides, is used.

However, in the nonwovens of polyolefin fibers mixed with a HDPE/PP conjugate fiber or a HDPE/PET conjugate fiber, or two layer nonwovens, fibers having different melting points are used, causing disadvantages that the strength of nonwovens are lowered, and the heat-seal parts are easily peeled.

When the nonwovens are used as surface materials of diapers, water repellency is required to protect leakage of urine from the parts of crotch and waist gathers. In conventional heat-adhesive fibers of polyolefin, a water repellent oil agent, which is obtained by mixing an alkylphosphate having 16–18 carbon atoms or a paraffinic oil agent with a silicone oil or a fluoro carbon oil, are often used.

At the parts of the crotch and waist gathers, when nonwovens of the lining and nonwovens of the surface cloth are adhered or nonwovens and PE film are adhered, a hot-melt adhesive is used. In case of using the water repellent oil agent, the adhesion of nonwovens to such an adhesive is lowered and the sealed part is easily peeled. To avoid such disadvantages, much adhesive is used. However, it is required recently for diapers to be light, compact and of low-cost, so that by using a small quantity of the hot melt adhesive, nonwovens having high adhesion should be provided.

SUMMARY OF THE INVENTION

The present invention aims to provide a conjugate fiber, and nonwovens made of the fiber having high strength and soft feel in spite of heat treatment under low temperature and high-speed. The nonwoven has high adhesivity with a hot melt adhesive, and excellent water repellency.

The inventors of the present invention earnestly have studied to resolve the above problems and attained the invention as shown in the following.

(1) A low-temperature adhesive fiber, characterized in that a textile oil in an amount of 0.1–2.0% by weight per fiber, which comprises the following surfactant composition of 5–15% by weight of the following component (A), 5–45% by weight of the following component (B) and 40–90% by weight of the following component (C), is applied to a conjugate fiber of polyolefins having a core component of polypropylene and a sheath component of a bipolymer or terpolymer of olefins mainly containing propylene.

(A) at least one alkali metal alkyl sulfonate, (B) at least one compound selected from polyol esters and fatty acid alkanol amides, (C) at least one compound selected from dibasic acid esters and polyethylene glycol esters.

(2) The low-temperature adhesive fiber described in the above (1), wherein the bipolymer of olefins mainly containing propylene is a copolymer of 99–85% by weight of propylene and 1–15% by weight of ethylene.

(3) The low-temperature adhesive fiber described in the above (1), wherein the bipolymer of olefins mainly containing propylene is a copolymer of 99–50% by weight of propylene and 1–50% by weight of butene-1.

(4) The low-temperature adhesive fiber described in the above (1), wherein the terpolymer of olefins mainly containing propylene is a copolymer of 84–97% by weight of propylene, 1–10% by weight of ethylene and 1–15% by weight of butene-1.

(5) The low-temperature adhesive fiber described in any one of the above (1)–(4), wherein the alkali metal alkyl sulfonate is at least one alkali metal salt selected from the salts of an alkyl sulfonic acid of 8–18 carbon atoms and sodium or lithium.

(6) The low-temperature adhesive fiber described in any one of the above (1)–(4), wherein the polyol ester is an ester of at least one polyol selected from the group consisting of glycerin, pentaerythritol, sorbitol, sorbitan and sucrose, and having HLB of 5 or less.

(7) The low-temperature adhesive fiber described in any one of the above (1)–(4), wherein the fatty acid alkanol amide is at least one alkanol amide of saturated or unsaturated aliphatic acids having acyl groups of 8–22 carbon atoms.

(8) The low-temperature adhesive fiber described in any one of the above (1)–(4), wherein the dibasic acid ester is an ester of at least one dibasic acid selected from the group consisting of adipic acid, sebacic acid, phthalic acid, terephthalic acid, succinic acid and maleic acid.

(9) The low-temperature adhesive fiber described in any one of the above (1)–(4), wherein the polyethylene glycol ester is at least one mono or diester of fatty acids having alkyl groups of 8–18 carbon atoms and polyethylene glycol having a molecular weight of 200–800.

(10) The nonwovens made of the low-temperature adhesive fiber described in any one of the above (1) to (9).

(11) An article having water absorption properties, the article being made of the nonwovens described in the above (10).

DETAILED DESCRIPTION OF THE INVENTION

The present invention is particularly described in the following.

The polypropylene of the core component of the conjugate fiber in the present invention is a crystalline polymer principally containing propylene, preferably a polymer of the fiber grade having about 2–150 of MFR (230° C., 2.16 kg) and a melting point of about 158° C. or more. Such a polymer is obtained by a well-known polymerization method of propylene using a Ziegler-Natta catalyst.

The copolymer of a principal component of the sheath of the conjugate fiber in the present invention is an olefin bipolymer principally containing propylene, which comprises 99–85% by weight of propylene and 1–15% by weight of ethylene, an olefin bipolymer containing principally propylene, which comprises 99–50% by weight of propylene and 1–50% by weight butene-1, and an olefin terpolymer containing principally propylene, which comprises 84–98% by weight of propylene and 1–10% by weight of ethylene and 1–15% by weight of butene-1. The copolymer has a MFR (230° C., 2.16 kg) of about 3–50 and the melting point of about 120–158° C. or more. Such a copolymer is a solid copolymer which is obtained by copolymerization of olefins with the Ziegler-Natta catalyst, and it is substantially a random copolymer.

When the content of comonomers (ethylene and butene-1) in the copolymer is less than 1% by weight, a fiber having insufficient heat adhesion is obtained. When the melting point of the copolymer is not in the above range, any one of the heat sealing speed, the heat seal strength, the speed of production of nonwovens, the strength of nonwovens and the feel of nonwovens is lowered.

The above two components are spun by a well-known conjugate spinning method into sheath core type or eccentric sheath core type fibers, stretched, and crimped. The weight ratio of the conjugate components is preferably in the range of the sheath component/the core component=20/80–70/30% by weight. When the sheath component is less than 20%, the heat adhesivity of the fiber is lowered, and in producing nonwovens of the fibers it becomes difficult to obtain nonwovens having a sufficient tensil strength and low-temperature adhesion of the nonwovens made of the fiber. When the sheath component is more than 70%, the heat adhesivity is enough, but the heat shrinkage of the fiber becomes high, and the size stability of the web tends to be lowered during the production of nonwovens. The conjugation arrangement of the fiber is preferably concentric sheath core arrangement because the shrinkage of the web is little at the heat treatment. The conjugate fiber having 0.5–10.0d/f of fineness and a number of crimps of 3–60/25 mm has good carding processability and it is preferably used.

Surfactant composition (A) used in the present invention comprises at least one alkali metal alkyl sulphonate selected from the salts of an alkyl sulfonic acid of 8–18 carbon atoms and sodium or lithium. Sodium lauryl sulfonate, sodium myristyl sulfonate, sodium cetyl sulfonate and sodium stearyl sulfonate can be exemplified. Further, a salt having an alkyl group of 12–18 carbon atoms is preferred. A mixture of these salts also may be used.

The polyol ester used in surfactant composition (B) in the present invention is an ester of at least one polyol selected from the group consisting of glycerin, trimethylolethane, trimethylolpropane, pentaerythritol, sorbitol, sorbitan and sucrose, and having HLB of 5 or less. Particularly, glycerin monolaurate, glycerin monostearate, glycerin tristearate, sorbitan monooleate and sorbitan monostearate are preferably used.

The fatty acid alkanol amide used in the surfactant composition (B) in the present invention is obtained by reaction of an alkanol amine such as monoethanol amine, diethanol amine and N-(2-aminoethyl)-ethanol with a saturated or unsaturated fatty acid of 8–22 carbon atoms by a conventional amide formation method. As the alkanol amine, diethanol amine is preferably used. As the fatty acid, acids having 12–18 carbons atoms such as lauric acid, myristic acid, palmitic acid, stearic acid and oleic acid can be preferably used.

A mixture of these polyol esters and/or aliphatic alkanol amides may be used.

The dibasic acid ester used in surfactant composition (C) in the present invention is an ester of at least one dibasic acid selected from the group consisting of adipic acid, sebacic acid, phthalic acid, terephthalic acid, succinic acid and maleic acid. Particularly, dioctyl adipate, dibutoxyethyl sebacate and dioctyl phthalate are preferably used.

The polyethylene glycol ester used in surfactant composition (C) in the present invention is a mono or diester of polyethylene glycol having a molecular weight of 200–800 with fatty acid having alkyl groups of 8–18 carbon atoms. Particularly, the molecular weight of poly ethylene glycol is preferably 200–600 and the alkyl group of the fatty acid is preferably 12–18 carbon atoms. For example, polyethylene glycol (400) monostearate, polyethylene glycol (300) distearate, polyethylene glycol (400) distearate and polyethylene glycol (400) monooleate can be exemplified.

A mixture of these dibasic acid esters and/or polyethylene glycol esters may be used.

The textile oil used in the present invention is a mixture of the above-mentioned surfactant composition (A) of at least one alkylsulfonate, surfactant composition (B) of at least one compound selected from polyol esters and fatty acid alkanol amides, and surfactant composition (C) of at least one compound selected from dibasic acid esters and polyethylene glycol esters in the weight ratio of A/B/C= 5–15/5–45/40–90% (100% by weight in total).

When the weight ratio of each component of the textile oil is beyond the limits of the above formulation ratio, it exerts a bad influence against any of low temperature adhesion, heat sealability, adhesion to a hot melt adhesive and water repellency. It becomes difficult to obtain the merits of the present invention.

In the present invention, the above-mentioned textile oil is applied to the conjugate fiber in the ratio of 0.1–2.0% by weight, preferably 0.3–1.8% by weight to the fiber weight. When the amount of applied textile oil is less than 0.1% by weight, the low temperature adhesivity is not enough. When the amount exceeds beyond 2.0% by weight, the processability of the conjugate fiber at the carding process is lowered by undesirable lowering of crimping properties.

As a method for applying the textile oil to the conjugate fiber, a well-known method such as a method using touch rolls at a fiber-spinning process, a method using touch rolls at a fiber-stretching process or a method spraying the textile oil on the fiber after a crimping process can be used.

To the low-temperature adhesive fiber of the present invention, if necessary, other additives such as thermoplastic resin and the like can be mixed in the fiber, or other treating agent is applied to the fiber surface, provided that the merits of the present invention is maintained.

The nonwovens of the present invention can be obtained, by making the above-mentioned conjugate fiber which the textile oil is applied thereto is processed to a web having a desired basis weight by using a card machine, and by processing the web by a well-known method such as a needle punching method, a suction dryer method or a heat roll method. When the nonwovens are used for diapers and sanitary napkins, the single fiber fineness of 0.50–10.0 deniers is preferable, and the basis weight of the nonwovens of 8–50g/m$^2$ is preferable, and more preferably 10–30g/m$^2$. When the single fiber fineness is less than 0.5 deniers, it is difficult to obtain a homogeneous web by using a card machine. When the single fiber fineness exceeds beyond 10.0 deniers, coarse nonwovens are obtained. The surface materials made of such nonwovens are further undesirably rough to the touch. When the basis weight is less than 10g/m$^2$, the surface material is too thin to obtain sufficient strength. When the basis weight exceeds beyond 50g/m$^2$, although preferable strength is obtained, the nonwoven is rough to the touch and the cost becomes expensive for practical use.

In the nonwovens of the present invention, if necessary, other fibers can be mixed with the low temperature adhesive fiber of the present invention, provided that the merits of the present invention is maintained. As the other fibers, polyester fibers, polyamide fibers, polypropylene fibers, polyethylene fibers can be exemplified. In the nonwovens, 20% or more by weight of the fiber of the present invention should be contained in the mixture with the other fibers. When the amount of the fiber of the present invention is less than 20% by weight in the nonwovens, it becomes difficult to obtain sufficient strength or heat sealability of the nonwovens, and good adhesion to a hot melt adhesive and water repellency are not obtained in many cases.

DESCRIPTION OF THE PREFERRED EMBODIMENTS

The present invention is further illustrated but not limited by the following examples.

The physical values shown in the examples are determined by the following methods.

Amount Of Textile Oil

Using a Soxhlet extractor, a fiber sample 10 g was extracted under reflux with a mixed solvent of methanol/petroleum ether=1/1 for three hours, and after evaporating the solvent the weight of residues is determined.

Strength Of Nonwovens

Using a hot press comprising embossing rolls having a bonding area of 24% and a flat metal roll, which had been heated at a certain temperature, a card web was heat-treated under the conditions of a line pressure of 20kg/cm and a speed of 6 m/min to obtain nonwovens of a basis weight of 20g/m$^2$. The direction of machine flow (MD) was regarded as a length direction of nonwovens, and the direction rectangular to the direction of machine flow (CD) was regarded as a width direction of nonwovens. Test pieces having a length of 15 cm and a width of 5 cm were prepared, the tensile strength was determined by a tensile tester at a gripping distance of 10 cm and a tensile speed of 10cm/min.

Adhesion With Hot Melt Adhesives

Using the above test pieces having a length of 15 cm and a width of 2.5 cm, which had been cut from the above nonwovens for determining a tensile strength, a hot melt adhesive was applied to the emboss side of the test piece at a width of 1 mm. After 20 seconds, further one test piece was put on it to face each other at the emboss sides, and loaded a pressure of 2kg/cm$^2$ for 10 seconds. The pieces were allowed to stand for 24 hours in a thermostatic chamber at a temperature of 20° C. and a humidity of 40%. The breaking strength at the adhesive joint part with the hot melt was measured by a tensile tester at a gripping distance of 10 cm and a tensile speed of 10cm/min. Tester of adhesion for a hot melt adhesive: manufactured by JT Tooshi Co. Ltd., Model ASM-15 Applicator for applying: Model Noodson 3100 Adhesive: SEBS

Water Repellency

A test piece of 15 cm square was cut from the above nonwovens for determining a tensile strength, and the water-resistant pressure (mm) was determined at a up and down rate of 10cm/min according to JIS L1092 method A (a low water pressure method). It shows that, when the water-resistant pressure is higher, the water repellency is better. The nonwovens having a water-resistant pressure of 50 mm or more can be practically used.

Heat Sealability

Two test pieces of 2.5 cm width were cut from the above nonwovens for determining a tensile strength. Employing a pair of two test pieces made of the same nonwoven, or a pair of one test piece made of the above nonwoven and one test piece made of a nonwoven having a basis weight of about 20 g/cm$^2$ made of a polypropylene fiber (2d/f), one test piece was put on the other covering at the edges of 1 cm length, and hot-pressed at a certain temperature for three minutes at a pressure of 3 kg/cm$^2$. The peel strength of the heat-sealed edges was measured by a tensile tester at a gripping distance of 10 cm and a tensile speed of 10cm/min.

EXAMPLES 1–6 AND COMPARATIVE EXAMPLES 1–3

Conjugate fibers having conjugate volume ratio of 40/60 (sheath component/core component) in which the sheath component was bipolymer (A) of MFR 15 comprising 5% by weight of butene-1 and 95% by weight of propylene, and the core component was crystalline polypropylene (homopolymer) of MFR 10 were spun at a temperature of 300° C. and a take-off speed of 1000m/min to obtain unstretched conjugate fibers of a concentric sheath/core type having a single fiber fineness of 4d/f. In the take-off process just after spinning, textile oils having compositions shown in Table 1 were adhered by a touch roll. Then, the fibers were stretched to 2.4 times of the original length by a heat roll at a temperature of 95° C. The fibers were crimped in a stuffing-box, dried at a temperature of 95° C. and cut-off to obtain conjugate fibers 2d×38mm (Examples 1 and 2).

Conjugate fibers having conjugate volume ratio 40/60 (sheath component/core component) that the sheath component was terpolymer (B) of MFR 10 comprising 3% by weight of ethylene, 5% by weight of butene-1 and 92% by weight of propylene, and the core component was crystalline polypropylene (homopolymer) of MFR 10 were spun at a temperature of 300° C. and a take-off speed of 1000m/min to obtain unstretched conjugate fibers of a concentric sheath/core type having a single fiber fineness of 4d/f. In the take-off process just after spinning, textile oil having composition shown in Table 1 were adhered by a touch roll. Then, the fibers were stretched to 2.4 times of the original length by a heat roll at a temperature of 95° C. The fibers were crimped in a stuffing-box, dried at a temperature of 90° C. and cut-off to obtain conjugate fibers 2d×38mm (Examples 2–6 and Comparative examples 1–3).

TABLE 1

| Composition of textile oil (% by weight) | Textile oil No. 1 | 2 | 3 | 4 | 5 | 6 |
|---|---|---|---|---|---|---|
| A Sodium stearyl sulfonate | 10 | 10 | 5 | 10 | 2 | 40 |
| B Glycerine tristearate | | | | 35 | 45 | |
| Sorbitan monolaurate | 9 | 10 | | | | 2 |
| Diethanol amide laurate | | 10 | 21 | | 10 | |
| C Dioctyl phthalate | 43 | 38 | | | 7 | |
| Dioctyl adipate | | | 32 | 20 | | |
| PEG (300) distearate | | | 42 | 35 | 36 | 58 |
| PEG (400) distearate | 38 | 32 | | | | |

TABLE 2

| | Conjugate fibers Core/Sheath | Textile oil Textile oil No. | Textile oil Amount (wt %) | Strength of nonwovens (CD) g/5 cm 120° C. | 124° C. | 128° C. | 132° C. | Hot melt adhesive strength (g) | Water-repellency Water pressure resistance (mm) |
|---|---|---|---|---|---|---|---|---|---|
| Examples | | | | | | | | | |
| 1 | PP-1/PO-1 | 1 | 1.00 | 525 | 890 | 1384 | 1665 | 880 | 77 |
| 2 | PP-1/PO-1 | 2 | 1.00 | 550 | 970 | 1450 | 1757 | 890 | |
| 3 | PP-1/PO-2 | 3 | 1.00 | 580 | 985 | 1384 | 1730 | 840 | 62 |
| 4 | PP-1/PO-2 | 4 | 0.20 | 453 | 790 | 1257 | 1688 | 750 | |
| 5 | PP-1/PO-2 | 4 | 1.00 | 576 | 1150 | 1650 | 1790 | 870 | 72 |
| 6 | PP-1/PO-2 | 4 | 1.80 | 620 | 1205 | 1680 | 2020 | 1030 | |
| Comparative Exs | | | | | | | | | |
| 1 | PP-1/PO-2 | 5 | 1.00 | 155 | 350 | 689 | 1240 | 152 | |
| 2 | PP-1/PO-2 | 6 | 1.00 | 80 | 330 | 750 | 1300 | 220 | 25 |
| 3 | PP-1/PO-2 | 4 | 0.05 | 245 | 430 | 867 | 1359 | 374 | |

PP-1: Polypropylene
PO-1: Bipolymer
PO-2: Terpolymer
Blank: No test

Strength Of Nonwovens

The above fibers were carded at a speed of 20m/min with a roller carding machine to obtain webs having a basis weight of 20g/m$^2$. The webs were then passed through embossing rolls having a bonding area of 24% at a certain temperature and the same speed to obtain nonwovens.

The strength of nonwovens was determined and the results are shown in Table 2.

Hot Melt Adhesion Test

In the nonwovens of Examples 1–6 and Comparative examples 1–3, using the nonwovens obtained at a bonding temperature of 128° C., the hot melt adhesion strength was determined and the results are shown in Table 2.

Water Repellency Test

In the nonwovens of Examples 1,3 and 5 and Comparative example 2, using the nonwovens obtained at a bonding temperature of 128° C., the water repellency (water pressures) was determined and the results are shown in Table 2.

Heat Seal Test 1

In the nonwovens of Examples 1–6 and Comparative examples 1–3, the nonwovens obtained at a bonding temperature of 128° C. were heat-sealed at a temperature of 130–145° C. Heat seal strength of these nonwovens are shown in Table 3.

Heat Seal Test 2

In the nonwovens of Examples 1–6 and Comparative examples 1–3, using the nonwovens obtained at a bonding temperature of 128° C. and polypropylene nonwovens (manufactured by Mitsui Sekiyu Kagaku Co. Ltd.) having a basis weight of 20g/m$^2$ obtained with a spun bond method were heat-sealed at a bonding temperature of 135–150° C. The peel strength is shown in Table 3.

TABLE 3

| | Heat seal test 1 (with the same nonwovens) g/2.5 cm | | | | Heat seal test 2 (with PP-SB) g/2.5 cm | | | |
|---|---|---|---|---|---|---|---|---|
| | 130° C. | 135° C. | 140° C. | 145° C. | 135° C. | 140° C. | 145° C. | 150° C. |
| Examples | | | | | | | | |
| 1 | 220 | 900 | 1800 | >2800 | non | 120 | 750 | 1750 |
| 2 | 240 | 950 | 1950 | >2200 | non | 120 | 905 | 1800 |
| 3 | 205 | 880 | 1900 | >2600 | non | 100 | 890 | 1850 |
| 4 | 185 | 920 | 1850 | >2600 | 50 | 165 | 850 | 1890 |
| 5 | 250 | 910 | 1950 | >2300 | 80 | 200 | 980 | 1950 |
| 6 | 350 | 1230 | 2300 | >2700 | 140 | 250 | 1150 | 2030 |
| Comparative Exs | | | | | | | | |
| 1 | 90 | 260 | 860 | 1650 | non | non | 450 | 1200 |
| 2 | 65 | 320 | 930 | 1730 | non | non | 340 | 1050 |
| 3 | 70 | 230 | 867 | 1800 | non | 50 | 550 | 1400 |

PP-SB: Spunbond nonwovens of polypropylene
non: Not adhered
>: Nonwovens breaked at an area except heat sealed areas.

The textile oil used in Examples 1–6 are the typical textile oil used in the present invention, and other compounds of surfactant composition (A), (B) and (C) have similar merits.

Nonwovens having high strength can be produced by heat treatment of the low temperature adhesive fibers at a low temperature and for a short time. The nonwovens made of the low temperature adhesive fibers have good heat-sealability to the other polyolefin nonwovens, and have excellent bond strength with a hot melt adhesive. Since the water repellency is 50 mm or more, such nonwovens can be preferably used in fields of surface materials such as disposable diapers and sanitary napkins.

We claim:

1. A low-temperature adhesive hydrophobic fiber, wherein a textile oil in the amount of 0.1–2.0% by weight of the fiber, which comprises essentially of the surfactant composition of 5–15% by weight of the following component (A), 5–45% by weight of the following component (B) and 40–90% by weight of the following component (C), is applied to a conjugate fiber of polyolefins having a core component of polypropylene and a sheath component of a bipolymer or terpolymer of olefins principally containing propylene:

(A) at least one alkali metal alkyl sulfonate, (B) at least one compound selected from polyol esters and fatty acid alkanol amides, (C) at least one compound selected from dibasic acid esters and polyethylene glycol esters.

2. The low-temperature adhesive fiber described in claim 1, wherein the bipolymer of olefins principally containing propylene is a copolymer of 99–85% by weight of propylene and 1–15% by weight of ethylene.

3. The low-temperature adhesive fiber described in claim 1, wherein the bipolymer of olefins mainly containing propylene is a copolymer of 99–50% by weight of propylene and 1–50% by weight of butene-1.

4. The low-temperature adhesive fiber described in claim 1, wherein the terpolymer of olefins principally containing propylene is a copolymer of 84–97% by weight of propylene, 1–10% by weight of ethylene and 1–15% by weight of butene-1.

5. The low-temperature adhesive fiber described in any one of claims 1–4, wherein the alkali metal alkyl sulfonate is at least one alkali metal salt selected from the salts of an alkyl sulfonic acid of 8–18 carbon atoms and sodium or lithium.

6. The low-temperature adhesive fiber described in any one of claims 1–4, wherein the polyol ester is an ester of at least one polyol selected from the group consisting of glycerin, pentaerythritol, sorbitol, sorbitan and sucrose, and having HLB of 5 or less.

7. The low-temperature adhesive fiber described in any one of claims 1–4, wherein the fatty acid alkanol amide is at least one alkanol amide of saturated or unsaturated fatty acids having acyl groups of 8–22 carbon atoms.

8. The low-temperature adhesive fiber described in any one of claims 1–4, wherein the dibasic acid ester is an ester of at least one dibasic acid selected from the group consisting of adipic acid, sebacic acid, phthalic acid, terephthalic acid, succinic acid and maleic acid.

9. The low-temperature adhesive fiber described in any one of claims 1–4, wherein the polyethylene glycol ester is at least one mono or diester of fatty acids having alkyl groups of 8–18 carbon atoms and polyethylene glycol having a molecular weight of 200–800.

10. A nonwoven made of the low-temperature adhesive fiber described in claim 1.

11. An article having water absorption properties, the article being made of the nonwovens described in claim 10.

* * * * *